US005159736A

United States Patent [19]

Newell

[11] Patent Number: 5,159,736

[45] Date of Patent: Nov. 3, 1992

[54] BRUSH CONSTRUCTION

[75] Inventor: Robert L. Newell, West Paterson, N.J.

[73] Assignee: Andor Brush Company, West Paterson, N.J.

[21] Appl. No.: 716,530

[22] Filed: Jun. 17, 1991

[51] Int. Cl.[5] ..... A46B 3/16

[52] U.S. Cl. ..... 15/195; 15/190; 15/196; 15/199; 15/205; 401/129

[58] Field of Search ..... 15/160, 190, 191 R, 15/192, 193, 195, 196, 199, 194, 197, 205; 401/129, 290

[56] References Cited

U.S. PATENT DOCUMENTS

| | | | |
|---|---|---|---|
| 2,009,899 | 7/1935 | Nagl et al. | 401/129 |
| 2,164,244 | 6/1939 | Jung | 401/129 |
| 2,348,515 | 5/1944 | Baumgartner | 15/195 |
| 2,664,316 | 12/1953 | Winslow, Jr. et al. | 15/191 R |
| 2,932,050 | 4/1960 | Weiler | 15/195 |
| 3,357,038 | 12/1967 | Williamson et al. | 15/191 R |
| 3,562,835 | 2/1971 | Baumgartner | 15/195 |
| 4,666,323 | 5/1987 | Kessler | 401/129 |
| 4,690,579 | 9/1987 | Tuckman | 401/129 |

FOREIGN PATENT DOCUMENTS

| | | | |
|---|---|---|---|
| 2148470 | 4/1973 | Fed. Rep. of Germany | 15/199 |
| 729065 | 7/1932 | France | 401/129 |
| 1320865 | 12/1963 | France | 401/129 |
| 471782 | 9/1937 | United Kingdom | 401/129 |

*Primary Examiner*—Edward L. Roberts
*Assistant Examiner*—Reginald L. Alexander
*Attorney, Agent, or Firm*—Arthur T. Fattibene; Paul A. Fattibene

[57] ABSTRACT

A brush construction which includes a brush handle having a hollowed end portion for receiving a tuft of bristles. The tuft of bristles are reversely folded about a plastic filament, and the filament reversely folded whereby the free ends of the plastic filament and the associated tuft of bristles form a bundle which, when inserted into the hollow end portion of the handle is positively retained therein by the inherent resiliency of the bundle. To more securely retain the tuft of bristles to the handle, the handle may be made of plastic whereby the plastic filament can be sonically welded or fused to the plastic brush handle.

9 Claims, 1 Drawing Sheet

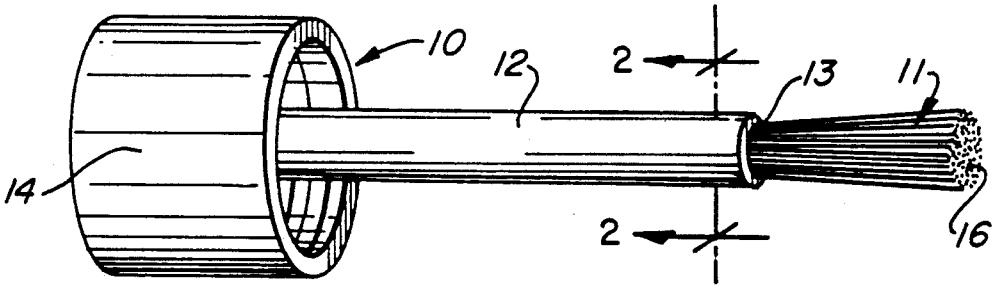
FIG. 1
FIG. 2
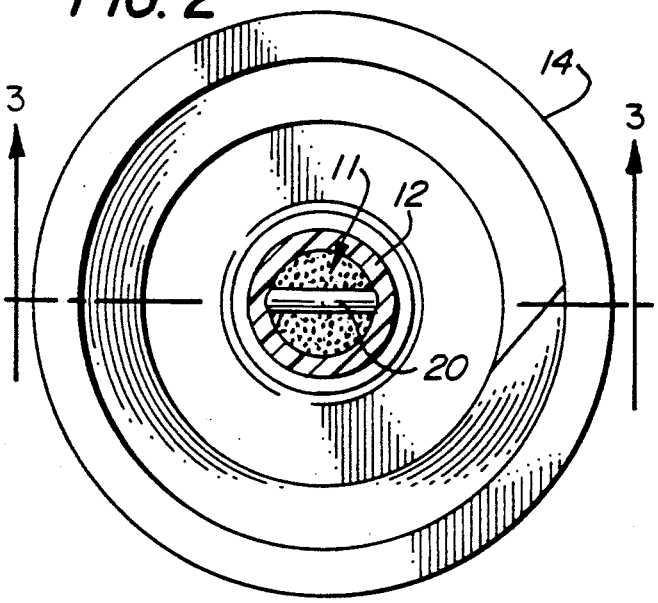
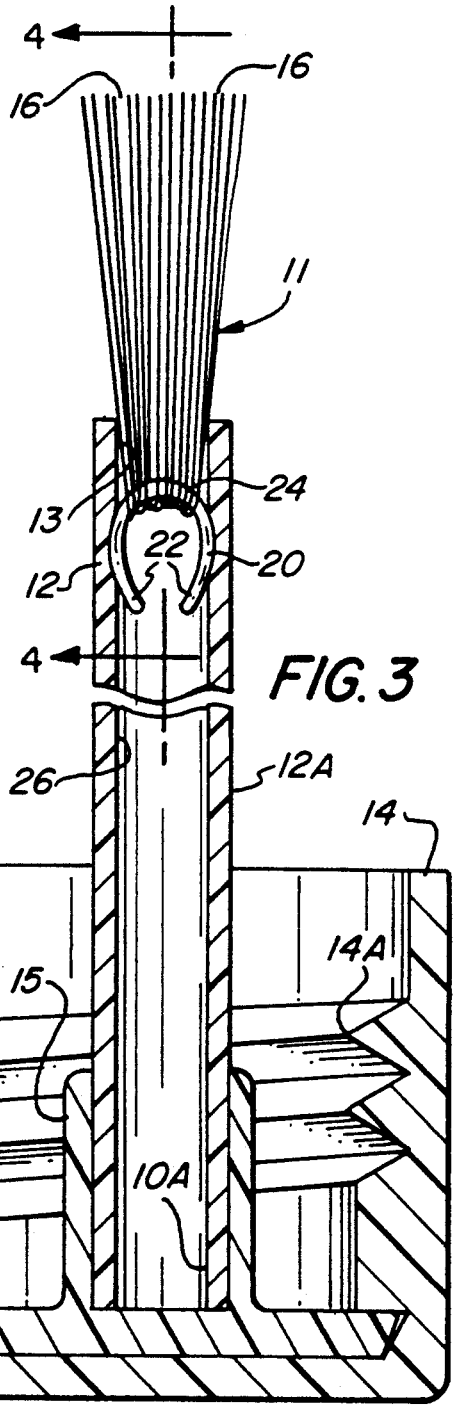
FIG. 3
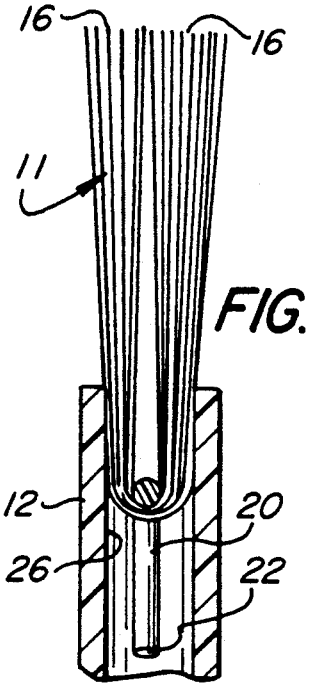
FIG. 4

BRUSH CONSTRUCTION

FIELD OF THE INVENTION

This invention relates generally to a brush construction, and more particularly an improved brush construction in which the tuft of bristles is firmly secured to a brush handle without utilizing a metal staple as heretofore.

BACKGROUND OF THE INVENTION

Heretofore, brushes of the type that are used as an applicator brush, i.e. brushes which are relatively small and inexpensive, have the tufts of bristles secured to the end of a brush handle by means of a metal staple. As the handle portion of such brushes are formed of a plastic material in the form of a relatively thin wall tube, it frequently happens that a portion or free end of the metal staple can penetrate the walls of the tubular handle to result in a hazardous or dangerous metal protrusion extending therefrom. This is particularly hazardous when the brush is to be used in applications where injury can result from such metallic protrusion, e.g. when such brush is utilized as an applicator for applying cosmetics to one's face and/or hands. In other applications, it has been noted that the use of a metal staple to retain a tuft of bristles to a brush handle can adversely react with the material which such brush is used to apply, e.g. applying material containing corrosive or acid components. Also, with the emphasis on recycling plastic products, the utilization of a metal staple in an otherwise all plastic brush can present a recycling problem.

Other known efforts of retaining a tuft of bristles to a brush handle includes the use of adhesives or glues. However, the gluing of tufts of bristles to a brush handle has proven to be relatively costly, difficult and time consuming, and has resulted in additional problems where the material being applied by such brushes tends to act as a solvent for the adhesive or glue used to bond the bristles to the brush handle; thereby causing the bristles to loosen from the brush handle.

OBJECTS

It is an object of the present invention to provide an improved brush construction whereby a plastic filament is utilized to secure a tuft of bristles to the end of a brush handle.

It is another object of the present invention to prevent any penetration of a brush handle by a metal staple heretofore used to secure a tuft of bristles thereto.

Another object is to provide a brush that will not react with the materials applied thereby.

Another object is to provide a brush construction which is free of any metallic component parts.

SUMMARY OF THE INVENTION

The foregoing objects and other advantages are attained by a brush construction having a brush handle whereby the tuft of bristles is secured thereto by a plastic filament. Essentially, the tuft of bristles is folded about a plastic filament which is reversely folded in a direction opposite to that of the bristles and which is inserted as a bundle assembly in the end of a brush handle. The resiliency of the bundle assembly consisting of the folded tuft of bristles about the oppositely folded plastic filament positively retains the tuft of bristles within the brush handle. The use of a plastic handle also permits the plastic filament to be sonically welded to the handle providing an integral and positive attachment of the tufts of bristles to the handle.

FEATURES

A feature of this invention resides in the provision of a plastic filament for retaining a tuft of bristles to the end of a brush handle.

Another feature resides in a brush construction which is free of any metallic components.

Another feature resides in the provision of a plastic filament capable of being fused to a plastic brush handle for positively securing the tuft of bristles to the end of a brush handle.

Another feature is to provide a brush construction which is relatively simple in construction, can be easily fabricated and which is safe and positive in operation.

These and other objects, advantages, and features will become readily apparent in view of the following more detailed description.

BRIEF DESCRIPTION OF THE DRAWINGS

FIG. 1 is a perspective view illustrating brush construction of the present invention.

FIG. 2 is a lateral cross section taken along line 2—2 in FIG. 1.

FIG. 3 is a longitudinal cross section taken along lines 3—3 in FIG. 2.

FIG. 4 is a sectional view taken along line 4—4 in FIG. 3.

DETAILED DESCRIPTION OF THE PREFERRED EMBODIMENT

FIG. 1 illustrates a brush construction 10 of the present invention. As shown, the brush 10 comprises a brush handle 12 having a tuft of bristles 11 inserted into a bore or opening defining a seat 13 formed in the end of the brush handle 12. In the illustrated embodiment, the brush handle is formed as a tubular member 12A having a bore 26 extending therethrough. Preferably, the handle 12 is made of a plastic material having a cylindrical cross section.

In accordance with this invention, the tuft of bristles 11 is retained in a seat 13 defined by an open end or bore 26 formed in the brush handle by means of a plastic filament 20 which may be made of nylon, polypropylene, polyethylene or other suitable plastic filament material. As best seen in FIGS. 3 and 4, a predetermined length of bristles 11 forming a tuft is reversely folded about the plastic filament 20, which itself is reversely folded in the opposite direction. See FIGS. 3 & 4. It will be noted that the free ends 22—22 of the plastic filament 20 are directed inwardly in open end or seat 13 of the brush handle and opposite to the free ends 16 of the bristles 11. The tuft of bristles 11 is inserted into the open end or seat of the brush handle or bore 26 with the free ends 22—22 of the plastic filament 20 leading the insertion. To facilitate the insertion, the free ends 22—22 of the filament 20 are pinched inwardly as shown in FIG. 3 causing the opposed sides of the reversely folded filament 20 to engage with a resilient force the internal diameter of the bore or seat 13; as best shown in FIG. 3. The force applied by the filament 20 to the inside diameter of the seat or bore serves to securely retain the tuft of bristles 11 within seat 13 of the brush handle 12. The force thus applied is a function of the resiliency of the plastic filament 20, the diameter of the filament 20, the material and quantity or number of strands of bristles 11 forming the tuft of bristles, and the inside diameter of seat 13 of the handle 12. The length of the free ends 22 of the plastic filament 20 also has some influence on the ability of the plastic filament 20 to hold the tuft of bristles within the seat 13 of the handle 12. A filament 20 formed from a length of nylon having a diameter of 0.0185+− and a length of 0.375" has performed well in a handle having a seat 13 with an inside diameter of 0.006" and with a bristle count ranging between 199 to 200 strands per tuft with each strand having a diameter of 0.0025".

In manufacturing the brush, the plastic filament 20 is cut to a predetermined length and a predetermined length of bristles 11 is reversely folded thereover to form the tuft. The plastic filament 20 is then bent into a U-shape and driven into the seat 13 with its free ends directed toward the seat 13 of the handle 12. The resilience of the plastic filament 20 and bristles 11 forming the bundle assembly forces the sides of the filament 22 outward to engage or contact the inside diameter of the seat 13 of the handle 12. The force exerted between the plastic filament 20 and the inside diameter 26 of handle 12 firmly holds the tuft of bristles 10 within the seat 13. If a more positive retention is required for a particular application for securing the tuft of bristles 11 to the brush handle 12, the plastic filament 20 may be easily sonically welded to the plastic handle 12. This creates an integral bond which is not possible with the use of conventional metal staples. Also, the plastic filament 20 obviates any unintentional protrusion associated with the conventional metal staple construction heretofore used. This is because the plastic filament 20, being relatively soft, cannot be forced through the side of handle 12 during the insertion of the tuft of bristles 11. The present invention results in a much safer brush assembly as no potentially hazardous metal staple is required. Additionally, because the brush can be made of all plastic material, the brush can very easily be recycled. Additionally, the corrosive problems caused by some solutions contacting a metal part, such as a staple, is eliminated with the use of the all-plastic construction described herein.

Therefore, the present invention of a brush having an all plastic construction using a plastic filament 20 retaining means has advantages and applications that have not previously been obtainable with a metal staple.

It will be understood that the plastic filament can be formed of any suitable plastic material, e.g. polypropylene, polyethylene in addition to nylon or other like plastics. While the invention has been described with respect to an applicator type brush, the invention can be utilized in brushes other than those commonly referred to as applicator brushes. For example, the invention can be applied to paint brushes, tooth brushes and the like.

As shown in FIG. 1, the brush 10 may be utilized in conjunction with a sealing cap 14. Many products are packaged in bottles and/or containers which are sealed by a cap, the contents of which are required to be applied by brushing. In such event, the brush 10 embodying the invention may be connected directly to the sealing cap 14 for such container as shown in FIGS. 1 and 4. As shown in FIG. 3, the cap 14, if threaded, is provided with internal threads 14A by which it can be releaseably connected to the container or bottle not shown. Disposed centrally of the cap 14 is a well or seat 15 having an internal diameter sized to frictionally receive and retain the end 10A of the brush handle. It will be understood that the handle may also be secured to the internal portion of the sealing cap 14 by other suitable means, e.g., by adhesives and the like. In lieu of threads 14A, the cap may be formed to provide a snap fit to detachably secure the cap to the bottle or container storing the material which is to be applied by the brush.

Although the invention has been illustrated add described with respect to a particular embodiment, it will be obvious to those skilled in the art that various modifications may be made without departing from the scope and spirit of this invention.

What is claimed is:

1. An applicator brush comprising:

a tubular handle having an internal bore having a predetermined uniform diameter extending the length of said tubular handle, said tubular handle being open at least at one end thereof, a tuft having a predetermined number of bristles, said tuft of bristles being reversely folded about an intermediate fold whereby the intermediate fold is adapted to be inserted into said open end of said tubular handle, and a resilient plastic filament reversely folded about said tuft of bristles at said intermediate fold and having a length greater than the cross section of said internal bore, said reversely folded plastic filament having opposed free ends positioned for insertion into said open end of said tubular handle whereby the inherent resiliency of said reversely folded plastic filament about said tuft of bristles exerts a positive lateral retaining force against the internal surface of said bore at said open end for securing said tuft of bristles within said open end.

2. An applicator brush as in claim 1 wherein: said handle is plastic.

3. An applicator brush as in claim 2 wherein:

said handle and said plastic filament are sonically welded together.

4. An applicator brush as in claim 1 wherein:

said plastic filament is made of nylon.

5. An applicator brush as in claim 1 further comprising:

a cap attached to the other end of said handle.

6. An applicator brush as in claim 5 wherein:

said cap is internally threaded.

7. An improved brush construction comprising:

an extruded plastic brush handle having a bore extending therethrough and having an opening formed at least at one end thereof to define a seat;

a tuft of a predetermined number of bristles reversely folded and secured to the open end of said brush handle within said seat;

means for securing said reversely folded bristles within said seat;

said latter means including a predetermined length of a resilient plastic filament;

said plastic filament being disposed intermediate the length of said tuft of bristles whereby said tuft of bristles is reversely folded about said filament and having a length greater than the cross section of said bore;

and said filament being reversely folded about said tuft of bristles in a direction opposite to the reverse fold of said tuft of bristles so that when inserted into said open end said filament having its free ends resiliently biased against the internal diameter of said seat whereby the retention force of said tuft of bristles to said brush handle consists of the function of the diameter and length of said filament, the internal diameter of said seat, and the predetermined number of bristles of a predetermined diameter comprising said tuft of bristles.

8. A disposable brush as in claim 7 wherein:

said cylindrical tube and said plastic filament are sonically welded together.

9. An improved brush construction as defined in claim 7 and including a sealing cap connected to the other end of said brush handle.

* * * * *